US009770927B2

(12) United States Patent
Boyd et al.

(10) Patent No.: US 9,770,927 B2
(45) Date of Patent: Sep. 26, 2017

(54) CONTAINER ASSEMBLY

(71) Applicant: Hewlett-Packard Development Company, L.P., Houston, TX (US)

(72) Inventors: Patrick V Boyd, Albany, NY (US); Milo A Undlin, Corvallis, OR (US); Mike M Morrow, Salem, OR (US); Michael E Goodale, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/307,462

(22) PCT Filed: Jun. 26, 2014

(86) PCT No.: PCT/US2014/444406
§ 371 (c)(1),
(2) Date: Oct. 28, 2016

(87) PCT Pub. No.: WO2015/199703
PCT Pub. Date: Dec. 30, 2015

(65) Prior Publication Data
US 2017/0050454 A1 Feb. 23, 2017

(51) Int. Cl.
*B41J 27/00* (2006.01)
*B41J 2/175* (2006.01)

(52) U.S. Cl.
CPC ..... *B41J 27/00* (2013.01); *B41J 2/1753* (2013.01); *B41J 2/17523* (2013.01); *B41J 2/17553* (2013.01); *B41J 2/17533* (2013.01); *B41J 2/17556* (2013.01)

(58) Field of Classification Search
None
See application file for complete search history.

(56) References Cited

U.S. PATENT DOCUMENTS

| | | | | |
|---|---|---|---|---|
| 6,203,146 | B1 | 3/2001 | Pawlowksi et al. | |
| 6,464,346 | B2 | 10/2002 | Otis, Jr. et al. | |
| 2001/0010531 | A1* | 8/2001 | Hsieh | B41J 2/17556 347/86 |
| 2004/0090501 | A1 | 5/2004 | Yoshida et al. | |
| 2006/0044369 | A1 | 3/2006 | Mutoh et al. | |
| 2014/0146112 | A1 | 5/2014 | Murray | |

* cited by examiner

*Primary Examiner* — Lisa M Solomon
(74) *Attorney, Agent, or Firm* — HP Inc. Patent Department

(57) ABSTRACT

Examples of a container assembly are disclosed herein. An example of the container assembly includes a regulated tank to supply printing composition and a free tank to supply reserve printing composition to the regulated tank. The container assembly also includes a regulator assembly to control flow of the reserve printing composition from the free tank to the regulated tank and an inflation assembly to prime the regulated tank to supply the printing composition. The container assembly additionally includes a labyrinth to fluidically isolate the flow of ambient air into and out of the regulator assembly from the flow of a supply of air into the inflation assembly.

15 Claims, 5 Drawing Sheets

CONTAINER ASSEMBLY

BACKGROUND

End users appreciate reliable components for their printing devices. They also appreciate cost-effective solutions for their printing needs. Designers and manufacturers may, therefore, endeavor to create and provide printing device components directed toward at least some of these objectives.

BRIEF DESCRIPTION OF THE DRAWINGS

The following detailed description references the drawings, wherein.

DETAILED DESCRIPTION

Printing devices deposit printing composition onto media. Printing devices may utilize printheads to deposit the printing composition onto the media. The printing composition for these printheads may be stored in and supplied by container assemblies.

A container assembly may utilize a regulator assembly for the function of controlling flow of printing composition within a body of the container assembly as the container assembly supplies printing composition to a printing device. The regulator assembly may also be utilized to accommodate changes in ambient pressure which might otherwise cause printing composition to leak from an unregulated container assembly. A container assembly may also utilize an inflation assembly for the function of priming the body of the container assembly to supply printing composition to a printing device.

The operations of the regulator assembly may be isolated from the operation of the inflation assembly. Additionally, the operations of the regulator assembly may also be isolated from each other. Providing such isolation may help to enhance the reliability of a container assembly. In some examples, this isolation should not unnecessarily increase the cost or complexity associated with the design and manufacture of a container assembly. Examples directed to achieving the foregoing are shown in FIGS. 1-7.

As used herein the term "printing device" represents a printer, plotter, press and/or device that uses any of the following marking technologies or a combination thereof: ink jet, dye sublimation, thermal transfer, 3D, laser, extrusion, off-set printing, dot matrix, or other suitable marking technologies. As used herein the terms "media" and "medium" are interchangeable and represent any type of paper or other printing medium (e.g., cloth, cardboard, canvas, transparency, substrate, powder, etc.), having any type of finish on either or both sides (e.g., glossy, matte, plain, textured, etc.), in any size, shape, color, or form (e.g., sheet, roll (cut or uncut), folded, etc.) on which printing composition (e.g., ink, toner, colorant, wax, dye, powder, latex, printing fluid or solid, etc.) is placed, jetted, deposited, dropped, ejected, formed, or laid to create text or items (e.g., text, images, graphics, pictures, formulas, charts, two-dimensional objects, three-dimensional objects, etc.). As used herein, the terms "printhead" and "printheads" represent a mechanism or device that implements any of the above-described marking technologies. A print head or print heads can be a single device or mechanism, or arranged in a module or array such as, for example, a print bar or page-wide array.

Figure 1:
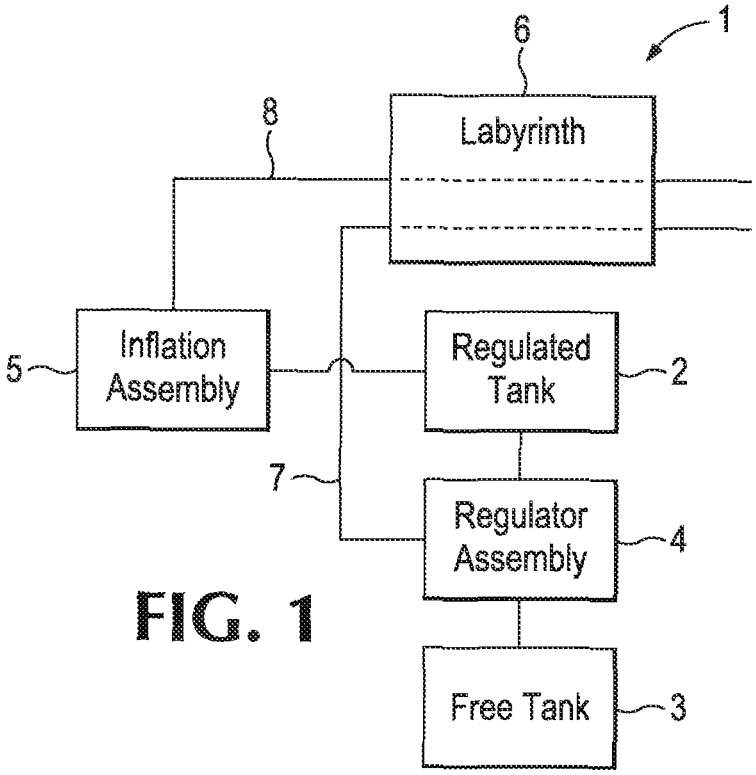
FIG. 1 is an example of a diagram of a container assembly.

An example of a diagram of a container assembly 1 is shown in FIG. 1. As can be seen in FIG. 1, container assembly 1 includes a regulated tank 2 to supply printing composition and a free tank 3 to supply reserve printing composition to regulated tank 2. Container assembly 1 also includes a regulator assembly 4 to control flow of the reserve printing composition from free tank 3 to regulated tank 2 and an inflation assembly 5 to prime regulated tank 2 to supply the printing composition. Container assembly 1 additionally includes a labyrinth 6 to fluidically isolate the flow of ambient air into and out of regulator assembly 4, as generally indicated by line 7, from the flow of a supply of air into the inflation assembly 5, as generally indicated by line 8.

Figure 2:
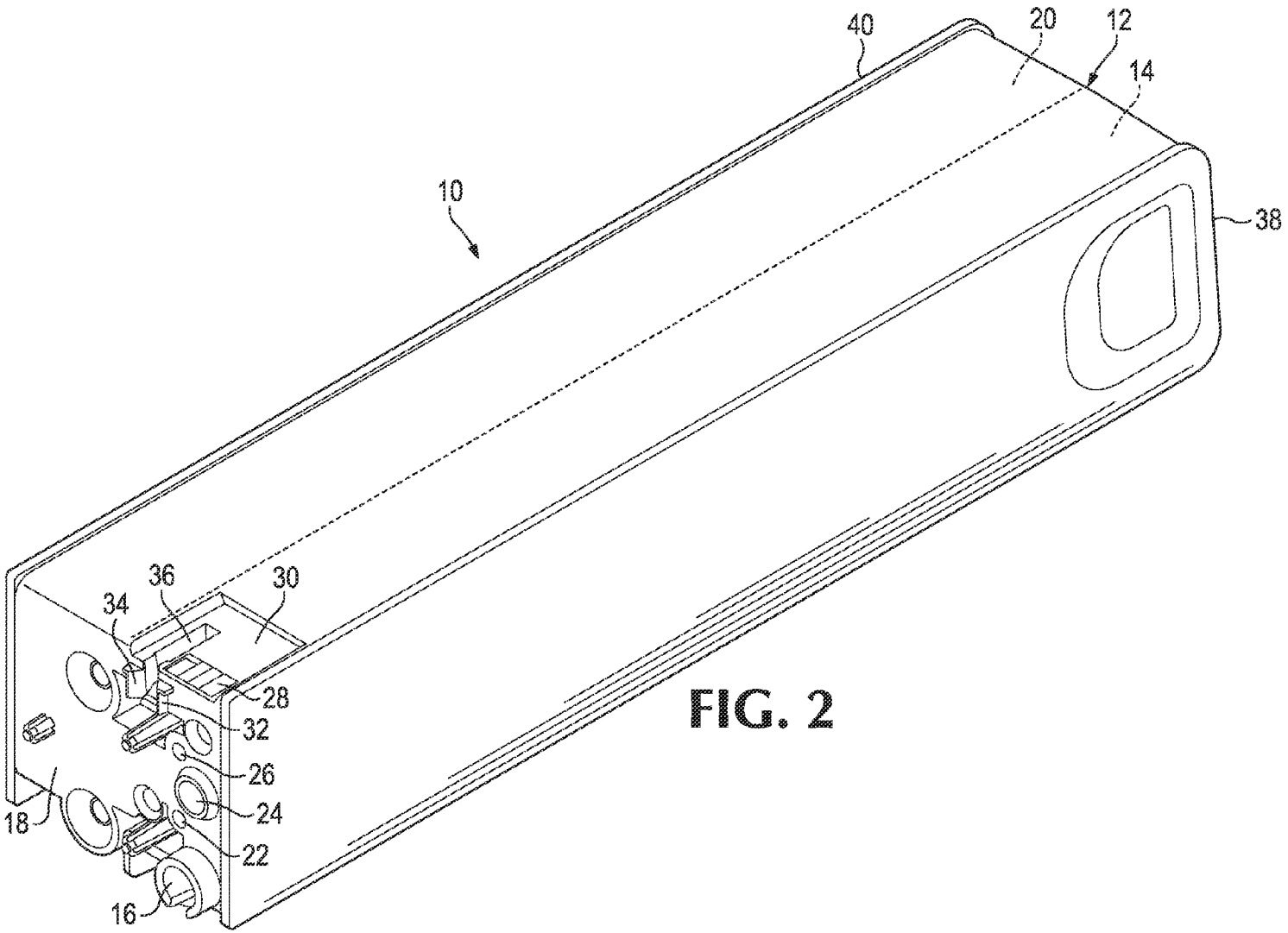
FIG. 2 is an example of a perspective view of a container assembly.

A perspective view of an example of a container assembly 10 is shown in FIG. 2. As can be seen in FIG. 2, container assembly 10 includes a body 12 to supply printing composition to a printing device (not shown). As can also be seen in FIG. 2, body 12 includes a regulated tank 14 to connect to a printing device via a printer supply port 16 on side 18 of body 12 to supply the printing composition from regulated tank 14 to the printing device. Body 12 also includes free tank 20 to store reserve printing composition that is supplied to regulated tank 12 on an as needed basis, as discussed more fully below.

As can also be seen in FIG. 2, regulated tank 14 also includes an ambient port 22 located on side 18 of body 12 to help regulate the flow of printing composition from free tank 20 to regulated tank 14. Regulated tank 14 additionally includes an inflation port 24 located on side 18 of body 12 that connects to a supply of air (not shown) to help prime regulated tank 14 of body 12 so that it supplies printing composition to a printing device. Regulated tank 14 further includes an ambient port 26 located on side 18 of body 12 that allows a regulator bag of a regulator assembly (not shown in FIG. 2) in regulated tank 14 to expand by drawing in air via ambient port 26 and collapse by forcing air out of ambient port 26. As will be discussed more fully below, the regulating assembly in conjunction with ambient port 22 helps to regulate the flow of printing composition from free tank 20 to regulated tank 14.

As can additionally be seen in FIG. 2, body 12 includes a memory 28 on a top surface 30 of body 12 that stores information that can be retrieved from memory 28 and utilized by a printing device. Information may also be written to memory 28 by a printing device. Body 12 also includes datums 32, 34, and 36 that are used to help properly position body 12 during its connection to a printing device. As can further be seen in FIG. 2, body 12 includes a pair of lids 38 and 40 that help to seal regulated tank 14 and free tank 20.

Figure 3:
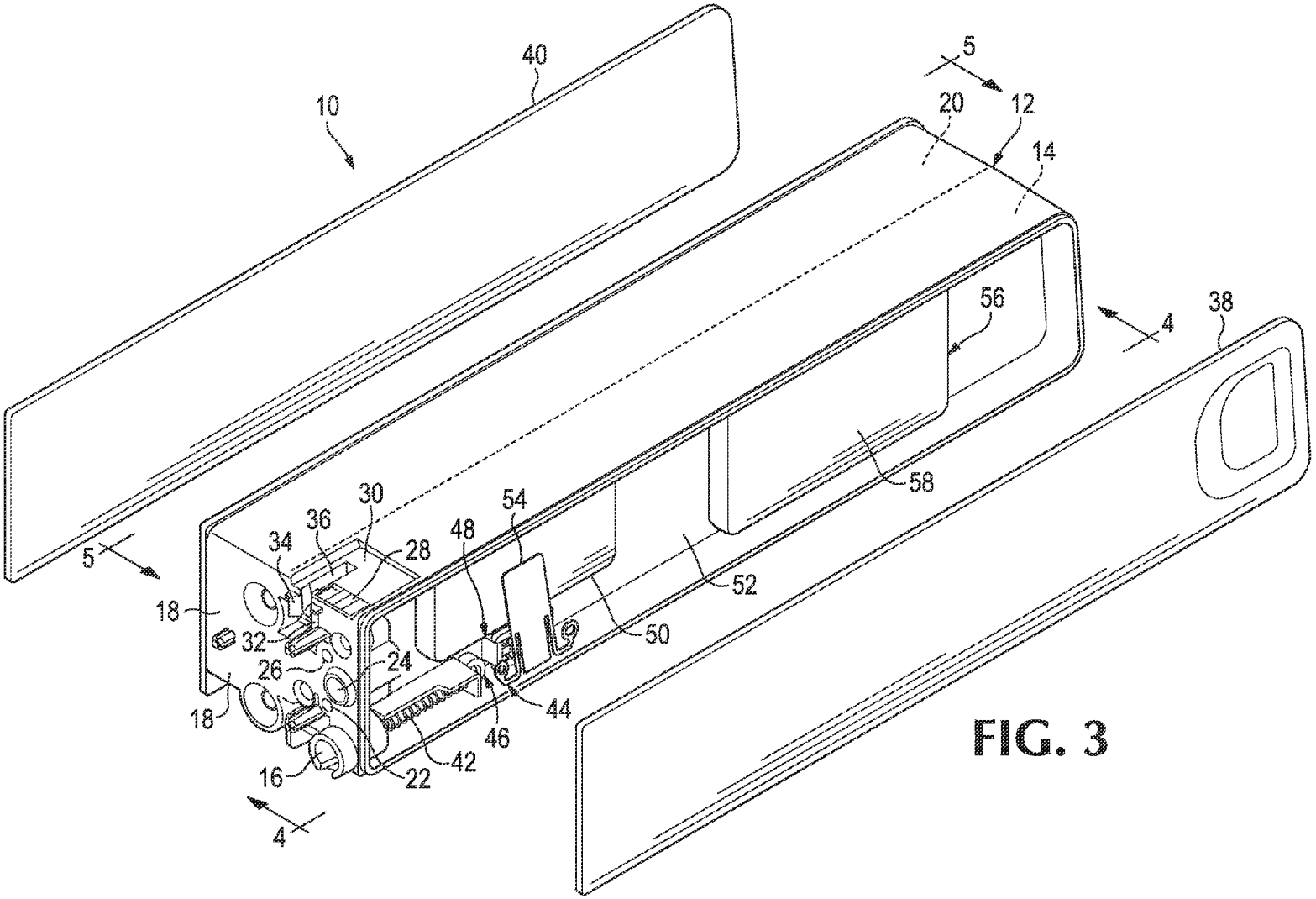
FIG. 3 is an example of a partially exploded perspective view of the container assembly of FIG. 1.

An example of a partially exploded perspective view of container assembly 10 is shown in FIG. 3. As can be seen in FIG. 3, regulated tank 14 of container assembly 10 includes a biased connector 42 adjacent printer supply port 16 to connect to a printing device (not shown). As can also be seen in FIG. 3, regulated tank 14 additionally includes a regulator assembly 44 to control flow of the supply of reserve printing composition from free tank 20 to regulated tank 14 via valve assembly 46 of container assembly 10. Regulator assembly 44 includes a regulator valve 48, a regulator bag 50 adjacent wall 52 of regulated tank 12, and a lever 54 to couple regulator valve 48 to regulator bag 50. As discussed more fully below, flow of ambient air into regulator bag 50 via ambient port 26 expands regulator bag 50 of regulator assembly 44 to actuate regulator valve 48 via lever 54 to allow ambient air to flow into free tank 20 via regulator valve 48 and ambient port 22 which displaces reserve printing composition in free tank 20 into regulated tank 14 via valve assembly 46.

As can additionally be seen in FIG. 3, regulated tank 14 of container assembly 10 also includes an inflation assembly 56 in regulated tank 14 to prime regulated tank 14 to supply printing composition to a printing device via printer supply port 16. Inflation assembly 56 includes an inflation bag 58 adjacent wall 52 of regulated tank 14. As discussed more fully below, flow of air into inflation bag 58 via inflation port 24 by, for example, an external pump (not shown), expands inflation bag 58 of inflation assembly 56 which displaces printing composition out of regulated tank 20 and into a printing device via printer supply port 16. Although not shown in FIG. 3, it is to be understood that regulator assembly 44 may include a biasing member adjacent regulator bag 50 to help collapse regulator bag 50 by displacing air from regulator bag 50 out of ambient port 26. Also, although not shown in FIG. 3, it is to be understood that inflation assembly 56 may additionally or alternatively include a biasing member adjacent inflation bag 58 to help collapse inflation bag 58 by displacing air from inflation bag 58 out of inflation port 24.

Figure 4:
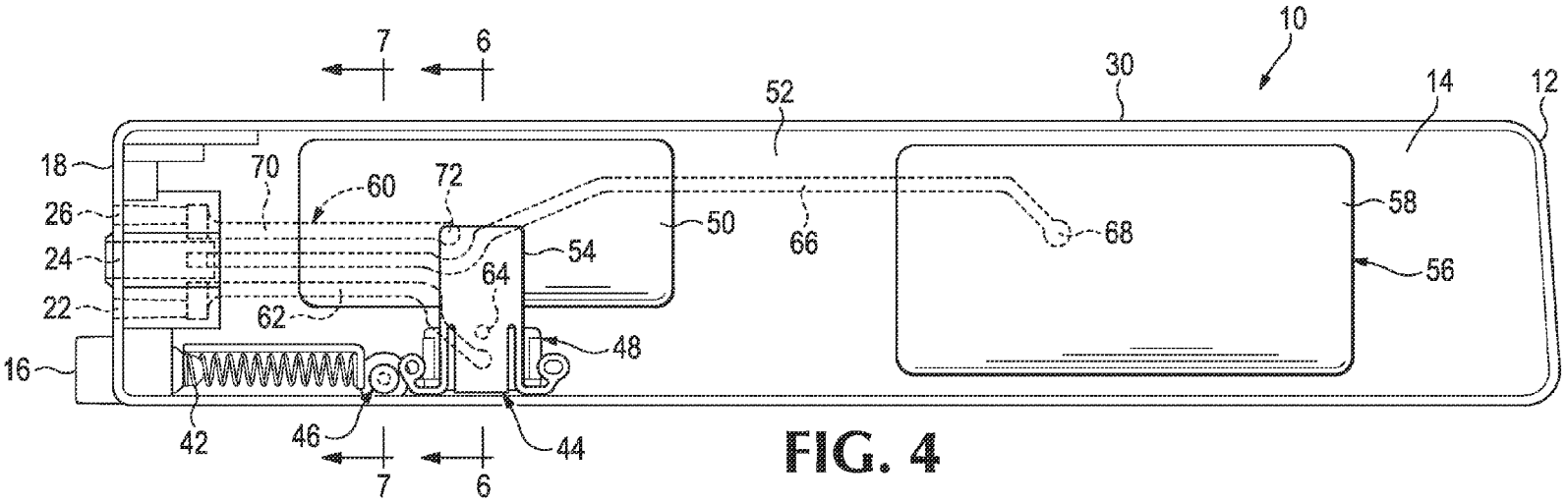
FIG. 4 is an example of a view of the container assembly of FIG. 3 along line 4-4 of FIG. 3.

An example of a view of container assembly 10 along line 4-4 of FIG. 3 is shown in FIG. 4. As can be seen in FIG. 4, container assembly 10 additionally includes a labyrinth 60 to fluidically isolate flow of ambient air into and out of regulator assembly 44 from flow of a supply of air into inflation assembly 56. Labyrinth 60 additionally fluidically isolates flow of ambient air into free tank 20 via regulator valve 48 of regulator assembly 44 from flow of ambient air into and out of regulator bag 50.

As can also be seen in FIG. 4, labyrinth 60 includes a first channel 62 between regulator assembly 44 and ambient air supplied via ambient port 22 to allow regulator assembly 44 to selectively connect the ambient air to regulator port 64 of free tank 20. Labyrinth 60 also includes a second channel 66 fluidically isolated from first channel 62 and coupled to inflation port 24 of regulated tank 12. Second channel 66 is also connected to inflation bag 58 of inflation assembly 56 via inflation assembly port 68. Labyrinth 60 also includes a third channel 70 fluidically isolated from both first channel 62 and second channel 66 to couple ambient port 26 to regulator bag 50 of regulator assembly 44 via regulator bag port 72.

Figure 5:
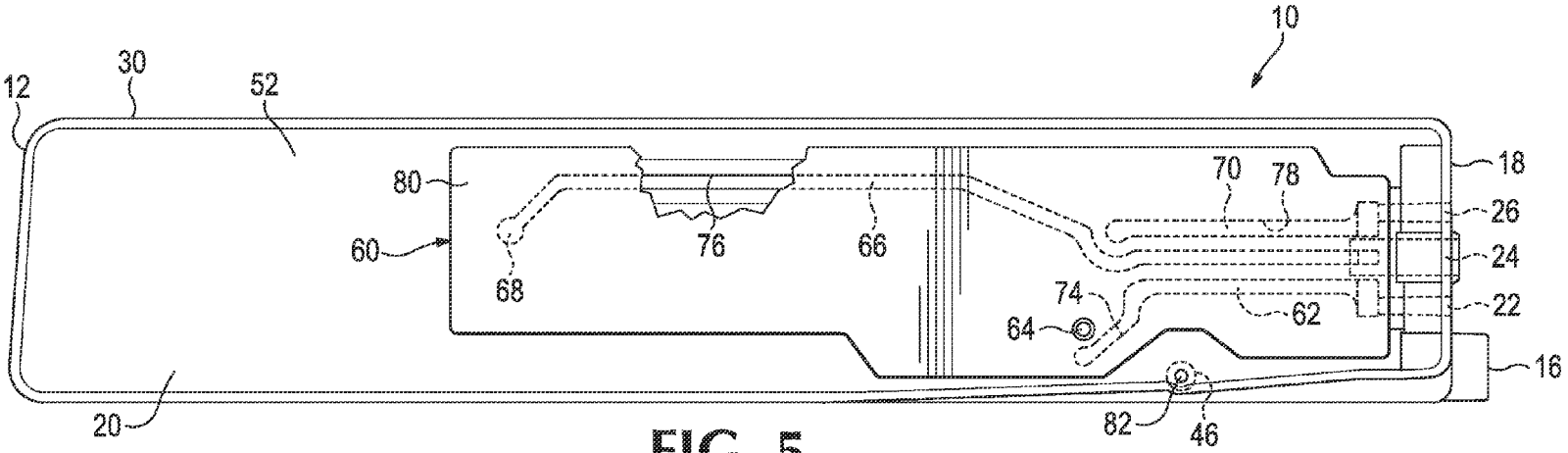
FIG. 5 is an example of a view of the container assembly of FIG. 3 along line 5-5 of FIG. 3.

An example of a view of container assembly 10 along line 5-5 of FIG. 3 is shown in FIG. 5. As can be seen in FIG. 5, first channel 62 of labyrinth 60 is defined by the combination of groove 74 in wall 52 and film 80 over groove 74 to seal groove 74. Second channel 66 of labyrinth 60 is defined by the combination of groove 76 in wall 52 and film 80 over groove 76 to seal groove 76. Third channel 70 of labyrinth 60 is defined by the combination of groove 78 in wall 52 and film 80 over groove 78 to seal groove 78. As can also be seen in FIG. 5, free tank 20 includes a printing composition supply port 82 coupled to valve assembly 46.

Figure 6B:
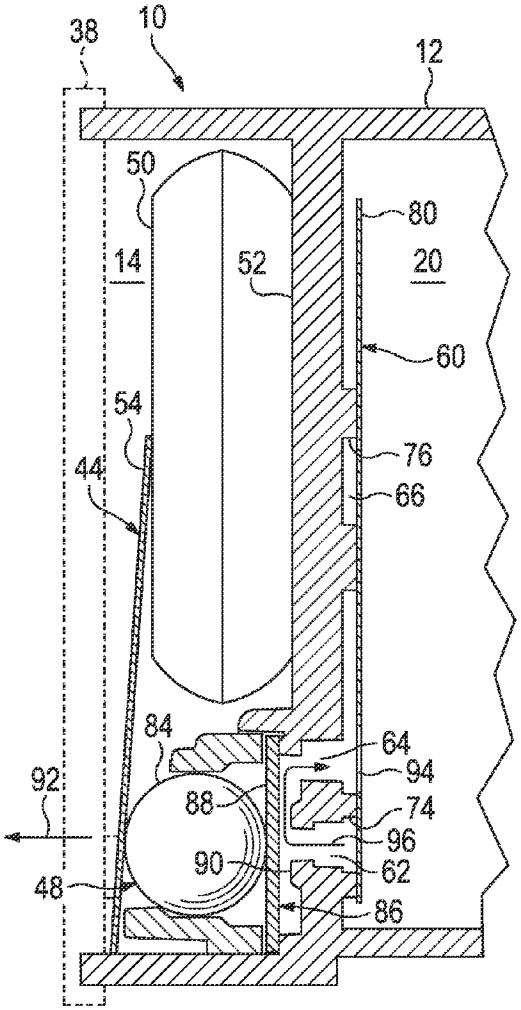
FIG. 6B is an example of another view of the container assembly of FIG. 4 taken along line 6-6 of FIG. 4.
Figure 6A:
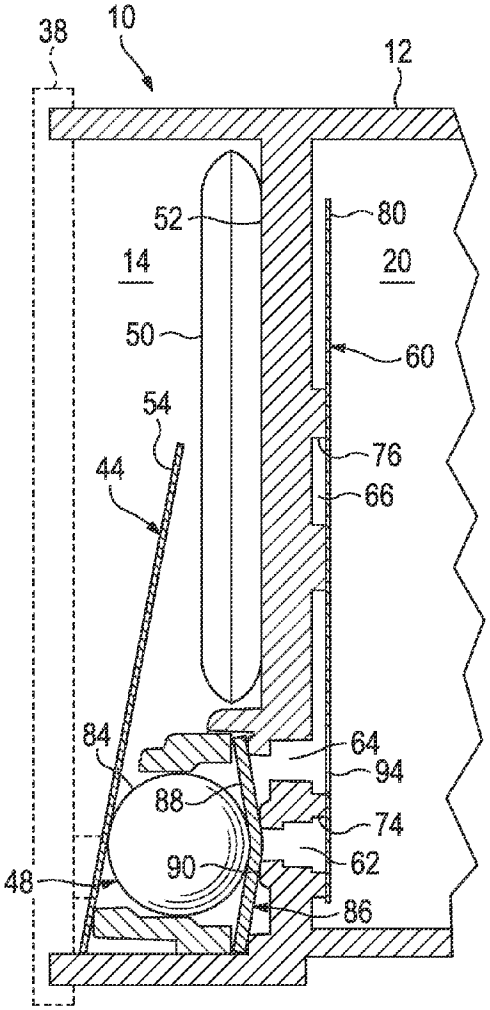
FIG. 6A is an example of a view of the container assembly of FIG. 4 taken along line 6-6 of FIG. 4.

An example of a view of container assembly 10 taken along line 6-6 of FIG. 4 is shown in FIG. 6A. As can be seen in FIG. 6A, regulator valve 48 of regulator assembly 44 includes a ball 84 coupled to lever 54 to actuate ball 84. Regulator valve 48 also includes a seal member 86 that includes a flexible disk 88 and a seat 90. Ball 84 is positioned adjacent seal member 86 to actuate seal member 86. As can also be seen in FIG. 6A, seal member 86 is actuated by ball 84 to deform flexible disk 88 which positions flexible disk 88 against seat 90 to seal regulator port 64 from first channel 62 of labyrinth 60. As can additionally be seen in FIG. 6A, regulator bag 50 of regulator assembly 44 is in a substantially deflated state.

An example of another view of container assembly 10 taken along line 6-6 of FIG. 4 is shown in FIG. 6B. As can be seen in FIG. 6B, regulator bag 50 of regulator assembly 44 is in a substantially inflated state. Regulator bag 50 inflates due to air entering regulator bag 50 via ambient port 26 (see, e.g., FIG. 4), third channel 70 (see, e.g., FIG. 4), and regulator bag port 72 (see, e.g., FIG. 4). Regulator bag 50 may inflate, as shown in FIG. 6B, because sufficient printing composition has left regulated tank 14 via printer supply port 16 (see, e.g., FIG. 4) to create a negative pressure in regulated tank 14.

As can also be seen in FIG. 6B, inflated regulator bag 50 pushes against lever 54 which actuates ball 84 of regulator valve 48 to move ball 84 in the direction of arrow 92. Movement of ball 84 of regulator valve 48 in the direction of arrow 92 allows flexible disk 88 of seal member 86 to move away from seat 90 to unseal regulator valve 48 so that regulator port 64 fluidly communicates with first channel 62 of labyrinth 60. This allows air to enter ambient port 22 (see, e.g., FIG. 4), travel through first channel 62 of labyrinth 60 to regulator port 64, and enter free tank 20 through hole 94 in film 80, as generally indicated by arrow 96. This movement of air into free tank 20 displaces reserve printing composition in free tank 20 forcing the reserve printing composition from free tank 20 into regulated tank 14 via an open valve assembly 46 (see, e.g., FIG. 4), as discussed more fully below in connection with FIG. 7.

As reserve printing composition enters regulated tank 14 from free tank 20 via valve assembly 46, the pressure in regulated tank 14 increases. This increasing pressure in regulated tank 14 causes regulator bag 50 to deflate by forcing air therein through regulator bag port 72 (see, e.g., FIG. 4) to ambient port 26 (see, e.g., FIG. 4) via third channel 70 (see, e.g., FIG. 4) of labyrinth 60. Eventually, the increased pressure in regulated tank 12 causes regulator bag 50 to deflate back to the condition shown in FIG. 6A. Deflation of regulator bag 50 allows lever 54 of regulator assembly 44 to actuate ball 84 of regulator valve 48, in a direction generally opposite of arrow 92 (see FIG. 6B), so that ball 84 forces flexible disk 88 of seal member 86 against seat 90 to seal regulator port 64 from first channel 62 of labyrinth 60.

Figure 7:
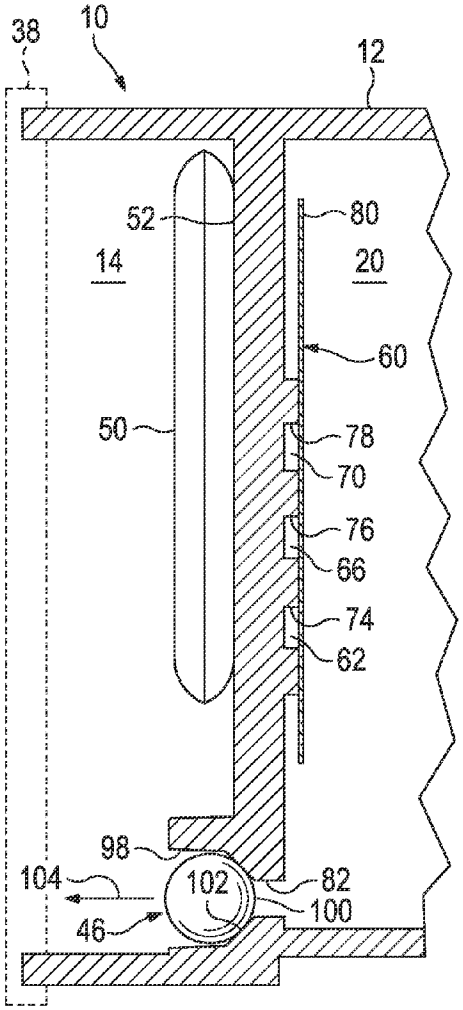
FIG. 7 is an example of a view of the container assembly of FIG. 4 taken along line 7-7 of FIG. 4.

An example of a view of container assembly 10 taken along line 7-7 of FIG. 4 is shown in FIG. 7. As can be seen in FIG. 7, regulated tank 14 of container assembly 10 includes a printing composition replenishment port 98. As can also be seen in FIG. 7, valve assembly 46 of container assembly 10 is positioned between printing composition supply port 82 and printing composition replenishment port 98. Valve assembly 46 additionally includes a ball 100 positioned against a seat 102 to close valve assembly 46, blocking the flow of reserve printing composition from printing composition supply port 82 of free tank 20 to printing composition replenishment port 98 of regulated tank 14 via valve assembly 46.

As can additionally be seen in FIG. 7, movement of ball 100 of valve assembly 46 away from seat 102 in the direction generally indicated by arrow 104, would open valve assembly 46, allowing reserve printing composition to flow from free tank 20 via printing composition supply port 82 through valve assembly 46 to regulated tank 14 via printing composition replenishment port 98. Ball 100 assumes the position shown in FIG. 7 against seat 102 to closed valve assembly 46 when the pressure in regulated tank 14 is greater than the pressure in free tank 20. Ball 100 moves in the direction generally indicated by arrow 104 away from seat 102 to open valve assembly 46 when the pressure in free tank 20 is greater than the pressure in regulated tank 14.

Although several drawings have been described and illustrated in detail, it is to be understood that the same are intended by way of illustration and example. These examples are not intended to be exhaustive or to be limited to the precise form disclosed. Modifications, additions, and variations may well be apparent. For example, regulator assembly 44 of container assembly 10 may also be utilized for the function of accommodating changes in ambient pressure which might otherwise cause printing composition to leak from printer supply port 16 if container assembly 10 is unregulated. As another example printer supply port 16, ambient port 22, inflation port 24 and/or ambient port 26 may be in a different location on container assembly 10 than as shown and described above.

Additionally, reference to an element in the singular is not intended to mean one, unless explicitly so stated, but rather means at least one. Furthermore, unless specifically stated, any method elements are not limited to the sequence or order described and illustrated. Moreover, no element or component is intended to be dedicated to the public regardless of whether the element or component is explicitly recited in the following claims.

What is claimed is:

1. A container assembly, comprising:

a regulated tank to supply printing composition;

a free tank to supply reserve printing composition to the regulated tank;

a regulator assembly to control flow of the reserve printing composition from the free tank to the regulated tank;

an inflation assembly to prime the regulated tank to supply the printing composition; and a labyrinth to fluidically isolate the flow of ambient air into and out of the regulator assembly from the flow of a supply of air into the inflation assembly.

2. The container assembly of claim 1, wherein the inflation assembly comprises an inflation bag, located in the regulated tank, and further wherein the flow of the air into the inflation assembly is to expand the inflation bag.

3. The container assembly of claim 1, wherein the regulator assembly comprises a regulator bag and a regulator valve, and further wherein the flow of the ambient air into the regulator assembly is to expand the regulator bag to actuate the regulator valve to allow the ambient air to flow into the free tank via the regulator valve to displace the reserve printing composition from the free tank into the regulated tank.

4. The container assembly of claim 3, wherein the labyrinth is to fluidically isolate the flow of ambient air into the free tank via the regulator valve from the flow of ambient air into and out of the regulator bag.

5. The container assembly of claim 1, wherein the regulator assembly comprises a regulator bag, and further wherein the flow of air into and out of the regulator assembly is to respectively expand and collapse the regulator bag to accommodate changes in ambient pressure.

6. A container assembly, comprising:

a regulated tank including a printing composition replenishment port and an inflation port;

a free tank including a printing composition supply port and a regulator port;

a valve assembly coupled to the printing composition replenishment port of the regulated tank and the printing composition supply port of the free tank;

a regulator assembly coupled to the regulator port of the free tank;

a first ambient air port; and a labyrinth including a first channel between the regulator assembly and the first ambient air port to allow the regulator assembly to selectively receive ambient air from the first ambient air port and to selectively direct that received ambient air to the regulator port of the free tank, the labyrinth including a second channel fluidically isolated from the first channel and coupled to the inflation port of the regulated tank.

7. The container assembly of claim 6, wherein one of the regulated tank and the free tank includes a second ambient air port, and further wherein the labyrinth includes a third channel fluidically isolated from both the first channel and the second channel to couple to the second ambient air port to the regulator assembly.

8. The container assembly of claim 7, wherein the regulator assembly includes a regulator bag coupled to the third channel of the labyrinth.

9. The container assembly of claim 6, wherein the regulator assembly includes a lever, a ball coupled to the lever, and a seal member positioned adjacent the ball, and further wherein the lever is coupled to the ball to actuate the ball to actuate the seal member.

10. The container assembly of claim 6, wherein the valve assembly includes a seat and a ball positionable against the seat, and further wherein movement of the ball away from the seat allows the reserve printing composition to flow from the free tank via the printing composition supply port to the regulated tank via the printing composition replenishment port.

11. The container assembly of claim 6, further comprising an inflation assembly connected to the second channel of the labyrinth.

12. The container assembly of claim 11, wherein the inflation assembly includes an inflation bag connected to the inflation port by the second channel of the labyrinth.

13. A container assembly, comprising:

a body to supply printing composition;

a regulator assembly to control the flow of printing composition in the body;

a first ambient air port;

a second ambient air port;

an inflation assembly to prime the body to supply the printing composition; and a labyrinth including a first channel coupled to the first ambient air port and the body, a second channel fluidically isolated from the first channel and coupled to the inflation assembly, and a third channel fluidically isolated from the first channel and the second channel to connect the regulator assembly to the second ambient air port.

14. The container assembly of claim 13, wherein the regulator assembly includes a regulator bag coupled to the third channel of the labyrinth.

15. The container assembly of claim 13, wherein the inflation assembly includes an inflation bag coupled to the second channel of the labyrinth.

* * * * *